US010773312B2

(12) United States Patent
Li et al.

(10) Patent No.: US 10,773,312 B2
(45) Date of Patent: Sep. 15, 2020

(54) PREPARATION METHOD FOR SILVER NANOWIRES WITH UNIFORM ASPECT RATIO AND NODES

(71) Applicant: CHONGQING UNIVERSITY OF ARTS AND SCIENCES, Chongqing (CN)

(72) Inventors: Lu Li, Chongqing (CN); Bitao Liu, Chongqing (CN); Rong Jin, Chongqing (CN); Shanyong Chen, Chongqing (CN); Junjun Li, Chongqing (CN); Hengqing Yan, Chongqing (CN)

(73) Assignee: CHONGQING UNIVERSITY OF ARTS AND SCIENCES, Chongqing (CN)

( * ) Notice: Subject to any disclaimer, the term of this patent is extended or adjusted under 35 U.S.C. 154(b) by 276 days.

(21) Appl. No.: 15/763,118

(22) PCT Filed: Mar. 15, 2016

(86) PCT No.: PCT/CN2016/076381
§ 371 (c)(1),
(2) Date: Mar. 25, 2018

(87) PCT Pub. No.: WO2017/059659
PCT Pub. Date: Apr. 13, 2017

(65) Prior Publication Data

US 2019/0054539 A1 Feb. 21, 2019

(30) Foreign Application Priority Data

Oct. 9, 2015 (CN) ..... 2015 1 0645719

(51) Int. Cl.
*B22F 9/24* (2006.01)
*B22F 1/00* (2006.01)

(52) U.S. Cl.
CPC ..... *B22F 9/24* (2013.01); *B22F 1/0025* (2013.01); *B22F 1/0044* (2013.01); *B22F 2301/255* (2013.01); *B22F 2304/054* (2013.01)

(58) Field of Classification Search
CPC ..... B22F 9/24
(Continued)

(56) References Cited

U.S. PATENT DOCUMENTS

2012/0247275 A1 10/2012 Yang et al.
2013/0192423 A1 8/2013 Yang et al.
(Continued)

FOREIGN PATENT DOCUMENTS

CN 102744417 10/2012
CN 102910595 A * 2/2013
(Continued)

OTHER PUBLICATIONS

CN 103170645 A Translation, Jun. 2013, Liang, Preparation method of silver nanowires (Year: 2013).*
(Continued)

*Primary Examiner* — Coris Fung
*Assistant Examiner* — Danielle Carda
(74) *Attorney, Agent, or Firm* — JCIPRNET

(57) ABSTRACT

A preparation method for silver nanowires, including: dissolving a dispersant in a tribasic alcohol to get a viscous clear solution, dissolving the silver nitrate in a tribasic alcohol to get a clear solution; then, adding the silver nitrate solution to the dispersant solution for uniform mixing, finally, transferring the mixed solution into a reaction kettle, putting into an oven with a set temperature (170~200° C.), and ending the reaction after a period of time. The mother solution of silver nanowires is diluted with alcohol and then centrifuged to separate organics, the novel silver nanowires with a uniform aspect ratio and nodes are obtained.

1 Claim, 2 Drawing Sheets

(58) Field of Classification Search
USPC ..... 75/371
See application file for complete search history.

(56) References Cited

U.S. PATENT DOCUMENTS

| | | | | |
|---|---|---|---|---|
| 2014/0102254 | A1* | 4/2014 | Jiang | B22F 1/0025 75/345 |
| 2015/0129813 | A1 | 5/2015 | Peng et al. | |

FOREIGN PATENT DOCUMENTS

| | | |
|---|---|---|
| CN | 103170645 | 6/2013 |
| CN | 104658700 | 5/2015 |
| CN | 104785794 | 7/2015 |
| CN | 105081350 | 11/2015 |
| JP | 2009108407 | 5/2009 |
| JP | 2013502515 | 1/2013 |
| KR | 20120129451 | 11/2012 |

OTHER PUBLICATIONS

CN102910595A Translation, Macro preparation method for superfine tellurium nanowires (Year: 2013).*

Haifei Lu et al., "Selective Growth and Integration of Silver Nanoparticles on Silver Nanowires at Room Conditions for Transparent Nano-Network Electrode", ACS NANO, Oct. 6, 2014, pp. 1-26.

"International Search Report (Form PCT/ISA/210)", dated Apr. 19, 2016, with English translation thereof, pp. 1-4.

* cited by examiner

PREPARATION METHOD FOR SILVER NANOWIRES WITH UNIFORM ASPECT RATIO AND NODES

CROSS-REFERENCE TO RELATED APPLICATION

This application is a 371 application of International PCT application serial no. PCT/CN2016/076381, filed on Mar. 15, 2016, which claims the priority benefit of Chinese application no. 201510645719.5, filed on Oct. 9, 2015. The entirety of each of the abovementioned patent applications is hereby incorporated by reference herein and made a part of this specification.

BACKGROUND OF THE INVENTION

1. Field of the Invention

The present invention relates to a preparation method for silver nanowires, and more particularly, to a preparation method for novel silver nanowires with nodes.

2. Description of Related Art

A nanowire has a one-dimensional structure limited to 100 nm or less in a lateral direction, and a typical metal nanowire has an aspect ratio of 1000 or more. Silver nanowires have good conductivity, transparency, flex resistance and other characteristics, so they can be used in flexible transparent conductive films. Through the efforts of researchers and scholars, many preparation methods for silver nanowires have been developed, such as the template method, hydrothermal method, self-assembly method, and polyol method. Many patents and papers disclosed the application of silver nanowires to flexible transparent conductive films. In 2011, Liu Cai-Hong et al. reported the preparation of transparent conductive films on flexible PET by using silver nanowires. The transparent conductive films had a conductivity of 175 Ω/sq and a transmittance of 75%. The properties of the flexible films were also studied. After 100 cycles of bending, the resistance change was less than 2%. (Nanoscale Re-search Letters, 2011, 6(75): 1-8.) In 2015, Chinese Patent No. 201510034152.8 disclosed an ethylene glycol reduction method for preparing Ag nanowires, which were used to prepare a transparent conductive electrode with a resistance of 0.9~795 Ω/sq. Haifei Lu et al prepared silver nanowires and then prepared a transparent conductive film with the silver nanowires, and then the film was immersed in an aqueous solution containing silver nitrate and sodium citrate, and was irradiated by light, so that silver particles at the intersections of the silver nanowires selectively grew. This greatly enhances the conductivity and stability of the transparent conductive film. (Haifei Lu, Di Zhang, Xingang Ren, Selective Growth and Integration of Silver Nanoparticles on Silver Nanowires at Room Conditions for Transparent Nano-Network Electrode, ACS Nano, 2014, 8 (10), pp 10980-10987). However, the above method was relatively complex. If novel silver nanowires with a uniform aspect ratio and nodes are prepared, and then transparent conductive films with the silver nanowires are prepared, nodes already exist at the intersections of the silver nanowires, and no subsequent processing is required. Therefore, it is very important to invent a preparation method for silver nanowires with a uniform aspect ratio and nodes that has fewer control factors, is simple and quick, has high yield and purity without particles.

SUMMARY OF THE INVENTION

The present invention is directed to a preparation method of novel silver nanowires with a uniform aspect ratio and nodes, which is simple, easy to control, and cost-effective.

The present invention is achieved through the following technical solution.

A preparation method for silver nanowires includes the following steps:

(1) dissolving a dispersant in a tribasic alcohol to get a viscous clear solution;

(2) dissolving silver nitrate in a tribasic alcohol to get a clear solution;

(3) adding the silver nitrate/tribasic alcohol solution to the dispersant/tribasic alcohol solution for uniform mixing, finally, transferring the mixed solution into a reaction kettle, reacting at 170-200° C. for 7-8 hours, and cooling in cold water to obtain a mother solution containing silver nanowires; and (4) diluting the mother solution containing the silver nanowires with absolute alcohol, and centrifuging to obtain the silver nanowires. The silver nanowires prepared with the method have a high purity.

To obtain nodes on the silver nanowires, the dispersant in the preparation method is polyvinylpyrrolidone (Mw≈1300000), and the tribasic alcohol is an analytically pure glycerol solution.

To enable the nodes on the prepared silver nanowires to be more even, have higher purity, and have a uniform aspect ratio, more preferably, in step (3), 40 ml, 0.05 M silver nitrate/tribasic alcohol solution is added into 60 ml, 0.67 M polyvinylpyrrolidone/tribasic alcohol solution for uniform stirring and mixing.

More preferably, the centrifuging is performed twice.

The present invention has the following beneficial effects:

The preparation of silver nanowires by using the present invention is a good alternative material for ITO. The silver nanowires of the present invention have nodes uniformly distributed, thereby significantly reducing the subsequent processing costs. The silver nanowires have a uniform aspect ratio, and transparent conductive films prepared with uniformly coating the silver nanowires slurry on a transparent film have a high transparency of over 85%. The silver nanowires have a diameter of 30-60 nm and a length of 10-20 μm which is beneficial to the subsequent improvement of electrical conductivity. In addition, the silver nanowires have no particles and feature high purity. The preparation method of the present invention is simple and easy to control, cost-effective, and suitable for large-scale industrial production.

DESCRIPTION OF THE EMBODIMENTS

The technology of the present invention will be further described below with reference to specific examples.

Example 1

40 ml, 0.05 M silver nitrate/tribasic alcohol solution was added into 60 ml, 0.67 M polyvinylpyrrolidone/tribasic alcohol solution for uniform stirring and mixing. The mixed solution was transferred into a reaction kettle, and finally, the reaction kettle was put into an oven heated to a temperature of 170° C. After holding the temperature for 8 h, the reaction kettle was taken out, and the experiment ended.

Figure 1:
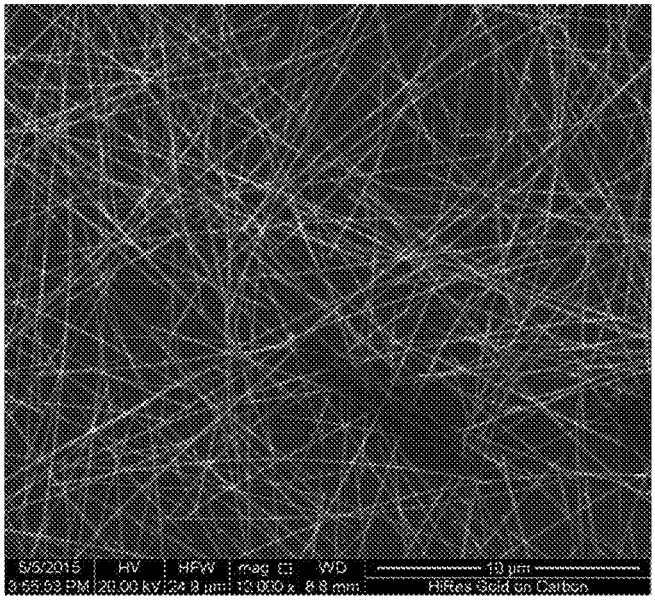
FIG. 1 is a scanning electron microscope (SEM) diagram of a silver nanowire synthesized in Example 1 of the present invention.
Figure 2:
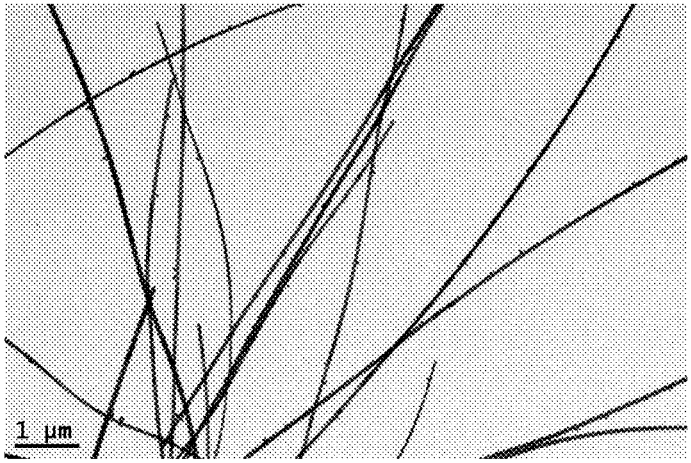
FIG. 2 is a transmission electron microscope (TEM) diagram of a silver nanowire synthesized in Example 1 of the present invention.
Figure 3:
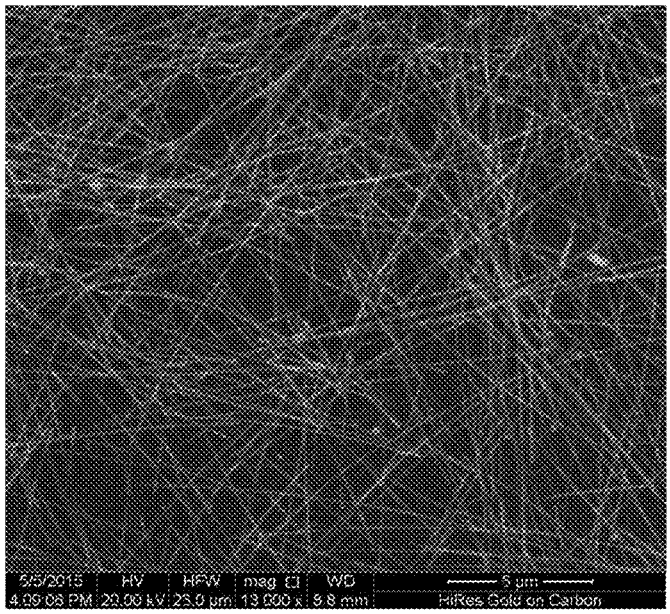
FIG. 3 is a scanning electron microscope (SEM) diagram of a silver nanowire synthesized in Example 2 of the present invention.

The mother solution of Ag nanowires in the reaction kettle was diluted with absolute alcohol, and was centrifuged twice to obtain the silver nanowires with a uniform aspect ratio and nodes. The silver nanowires had a diameter of 30-60 nm and a length of 10-20 μm, and were dispersed in isopropanol or absolute alcohol. FIG. 1 is a scanning electron microscope (SEM) diagram of a silver nanowire synthesized in this example of the present invention; and FIG. 2 is a transmission electron microscope (TEM) diagram of a silver nanowire synthesized in this example of the present invention.

Example 2

40 ml, 0.05 M silver nitrate/tribasic alcohol solution was added into 60 ml, 0.67 M polyvinylpyrrolidone/tribasic alcohol solution for uniform stirring and mixing. The mixed solution was transferred into a reaction kettle, and finally, the reaction kettle was put into an oven heated to a temperature of 200° C. After holding the temperature for 8 h, the reaction kettle was taken out, and the experiment ended.

The mother solution of Ag nanowires in the reaction kettle was diluted with absolute alcohol, and was centrifuged twice to obtain the silver nanowires with a uniform aspect ratio and nodes. The silver nanowires had a diameter of 30-60 nm and a length of 10-20 μm, and were dispersed in isopropanol or absolute alcohol. FIG. 2 is a scanning electron microscope (SEM) diagram of a silver nanowire synthesized in this example of the present invention.

What is claimed is:

1. A preparation method for silver nanowires with a uniform aspect ratio and nodes, comprising the following steps:

(1) adding 40 ml, 0.05 M silver nitrate/glycerol solution into 60 ml, 0.67 M polyvinylpyrrolidone/glycerol solution for uniform mixing, then transferring a mixed solution into a reaction kettle, and finally, putting the reaction kettle into an oven heated to a temperature of 200° C.; and after holding the temperature for 8 h, taking out the reaction kettle, and ending the experiment; and (2) diluting a mother solution containing the silver nanowires in the reaction kettle with absolute alcohol, and centrifuging twice to obtain the silver nanowires with the uniform aspect ratio and nodes, wherein the silver nanowires have a diameter of 30-60 nm and a length of 10-20 μm, and are dispersed in isopropanol or absolute alcohol.

* * * * *